US012279729B2

(12) United States Patent
Gross

(10) Patent No.: US 12,279,729 B2
(45) Date of Patent: Apr. 22, 2025

(54) CURVED OUTWARD SHOWER CURTAIN LINER

(71) Applicant: Glenn Steven Gross, Boynton Beach, FL (US)

(72) Inventor: Glenn Steven Gross, Boynton Beach, FL (US)

( * ) Notice: Subject to any disclaimer, the term of this patent is extended or adjusted under 35 U.S.C. 154(b) by 620 days.

(21) Appl. No.: 17/156,259

(22) Filed: Jan. 22, 2021

(65) Prior Publication Data

US 2021/0137320 A1 May 13, 2021

Related U.S. Application Data

(63) Continuation-in-part of application No. 15/610,390, filed on May 31, 2017, now abandoned.

(51) Int. Cl.
*A47K 3/38* (2006.01)

(52) U.S. Cl.
CPC ..... *A47K 3/38* (2013.01)

(58) Field of Classification Search
CPC ..... A47K 3/38
See application file for complete search history.

(56) References Cited

U.S. PATENT DOCUMENTS

| | | | | |
|---|---|---|---|---|
| 3,382,507 | A | 5/1968 | Micheau | |
| 5,771,504 | A * | 6/1998 | Steiner | A47K 3/38 4/558 |
| 7,770,243 | B1 * | 8/2010 | Wise | A47H 13/02 4/557 |
| 9,107,544 | B2 | 8/2015 | Cittadino | |
| 9,192,267 | B2 | 11/2015 | Tsibulevskiy | |
| 9,788,692 | B2 * | 10/2017 | Chenoweth | A47K 3/38 |
| 2018/0263429 | A1 * | 9/2018 | Haglund | A47H 23/08 |

* cited by examiner

*Primary Examiner* — Lauren A Crane
(74) *Attorney, Agent, or Firm* — Stephen E. Zweig

(57) ABSTRACT

A system and method for increasing the volume for showers bounded by shower curtains and/or shower curtain liners. This system uses a curved outward shower curtain liner device. This device generally comprises a foldable body, comprising a flexible, water impermeable, material configured with the body left sides and body right sides capable of reversibly folding and unfolding from a first shorter folded width to a second longer unfolded width. The shower curtain liner body further comprises a plurality of rigid or semi-rigid supports disposed from top to bottom. At least some of these supports are configured to be capable of assuming a curved state. In this curved state, portions of the support in between the support top and bottom assume a curvature with a displacement of at least six inches, thus causing the shower curtain liner to take a curved state, effectively increasing the volume of the shower.

18 Claims, 5 Drawing Sheets

CURVED OUTWARD SHOWER CURTAIN LINER

CROSS REFERENCE TO RELATED APPLICATIONS

This invention is a continuation in part of U.S. patent application Ser. No. 15/610,390, filed May 31, 2017, the entire contents of which are incorporated herein by reference.

BACKGROUND OF THE INVENTION

Field of the Invention

This invention is in the field of shower accessories. More particularly, the present disclosure relates to shower curtain liners.

Description of the Related Art

Shower curtains are well known. They typically consist of flexible, water-impermeable materials such as plastics or water repellant fabric used to contain the spray of a shower within the confines of a tub. Some shower curtains are their own liners, in that they have no additional layers of material. Other shower curtains may comprise two layers of flexible material, typically an outer "shower curtain" that faces away from the shower and often are disposed outside of the confines of the shower's tub. The inner layer, often called a shower curtain liner, is typically disposed inside of the shower tub. Because shower curtains can sometimes be their own shower curtain liners, in this disclosure, the two terms may occasionally be used interchangeably.

Shower curtains and shower curtain liners are typically mounted to a shower rod with individual, separate hooks that suspend the shower liner from the rod. These liners often include eyelets along a top edge, and the hooks extend through the eyelets and over the rod to hang the liner. Shower liners are often configured to be drawn to a closed position where the liner deflects water from the shower back into the shower or tub to prevent water from splashing onto the bathroom floor. Shower liners have also been constructed with hookless fasteners fixedly mounted to a top edge of the liner to suspend the liner from the shower rod.

Depending on various styles and product variance offerings, shower curtain liners can also be suspended on a shower rod, generally by separate hooks or hookless eyelets. Such shower curtain liners can effectively prevent water from spraying past the curtain during the showering process. In some cases, shower curtain liners may have magnets and/or suction cups to help hold the shower curtain liner in place to help prevent water from spraying past the shower curtain. Further, some prior art shower curtain liners have suction cups that help to hold the shower curtain along the sides to the shower tiles to prevent water from spraying past the shower curtain.

Prior art in this area includes Cittadino, U.S. Pat. No. 9,107,544; and Tsibuleviskiy, U.S. Pat. No. 9,192,267. Other work includes Steiner, U.S. Pat. No. 5,771,504; Micheau, U.S. Pat. No. 3,382,507; and Haughland US 2018/0263429,

BRIEF SUMMARY OF THE INVENTION

The invention is inspired, in part, by the observation that shower curtains and shower curtain liners can have an undesirable effect of being drawn into the shower while in operation. This restricts the volume of the shower itself and can make showering irritating for the person using the shower. Methods to retain the useful properties of shower curtains/shower curtain liners while also improving the volume of the shower, would thus be of practical and commercial interest.

The invention is also inspired, in part by the observations that shower liners may also not effectively stay flat against the walls of the shower on the ends of the shower, thus allowing water to escape.

The invention is also based on the observation that if the shower curtain liner can be created with a more favorable configuration, its corresponding shower curtain, assuming that the shower curtain is composed of a typical flexible shower curtain material, will itself deform to accommodate any additional volume produced by an improved shower curtain liner. Thus, producing an improved shower curtain liner will in itself help solve the above problems.

The present disclosure teaches curved outward shower curtain liners designed to overcome some of the above issues. These curved outward shower curtain liners may include a body having opposing side ends, an upper end, and a lower end opposing the upper end. As will be discussed, this body may vary in thickness and may be made from various usually flexible and/or foldable materials between the side ends. The curved outward shower curtain liner disclosed herein allows the liner to curve outward (away from the shower), making more usable room inside the shower for the user.

The body of the shower curtain liner may be made from various solid and semi-solid materials, as well as certain "smart materials" configured to allow for variations/transitioning the smart material's mechanical or optical properties in response to certain control signals (usually electronic control signals) or environmental stimuli (e.g., presence of water droplets).

For example, certain smart materials may be configured to vary their mechanical properties in response to certain control signals can be used to create shower curtain liners that can be relaxed to transition from a curved outward configuration to a more normal "flat" configuration. For example, a suitable moisture sensitive material may expand outward to create a curved outward configuration in the presence of moisture and relax back to a "flat" configuration in the absence of excess moisture. The same effect could be achieved in response to electrical signal sensitive "smart materials", light-sensitive "smart materials," and the like.

The shower curtain liner body is typically configured for opening from either side to side toward either side, with the curtain (curtain liner) collapsing into a bunch when a force is applied onto either end toward the other end. However, in some embodiments, the lower end for the horizontal model/version is configured for substantially remaining in place without response to vertical forces.

In some embodiments, the curved outward shower curtain liner disclosed herein may have supports, such as rubber or wire poles (which can be rigid and/or flexible curved whips) that can be sewn or seamed into the shower curtain liner. Further, in some embodiments, magnets, such as magnetic cards, may be affixed to the bottoms of the rubber or wire poles and also sewn or seamed into the curved outward shower curtain liner. These optional magnets can be of various shapes, including but not limited to circular, oval, triangle, rectangular, square, shapes, and the like. These magnets can be used to help secure the shower curtain liner to the inside of the certain types of shower tubs that comprise magnetically attractive material. This can be particularly useful for helping to secure the liner to the corners of certain types of shower tubs. For other types of tubs, suction cups, water resistant adhesives, or weights may be used.

In some embodiments, the invention may be a curved outward shower curtain liner comprising a body having opposing side ends, an upper end, and a lower end opposing the upper end. The body for the horizontal model/version can vary in thickness and be made from various usually flexible and/or foldable materials between the side ends. The body for the horizontal model/version may be configured for opening from either side to side toward either side collapsing into a bunch when a force is applied onto either end toward the other end.

The lower end for the horizontal model/version may be configured for substantially remaining in place without response to vertical forces. The body for the vertical model/version may vary in thickness and be made from various usually flexible and/or foldable materials between the upper and lower end. The body for the vertical model/version may be configured for opening from the lower end toward the upper end collapsing into a bunch/folding (like accordion window blinds) when a force is applied onto either end toward the other end. The lower end for the vertical model/version may also be configured for substantially remaining in place without response to typical shower caused and/or air pressure forces.

In some embodiments, the curved outward shower curtain liner may have supports (e.g., rubber or wire poles, hard, flexible curved whips, and the like) sewn or seamed into the shower curtain liner. This curved outward shower curtain liner can be configured to allow the liner to curve outward (away from the shower), making more usable room inside the shower.

The previously discussed magnets, suction cups, or other reversible tub detachment devices may be affixed to the bottoms of the supports and/or also sewn or seamed into the curved outward shower curtain liner. These may also be used to help secure the shower curtain liner to the inside of the shower tub (especially in the corners).

DETAILED DESCRIPTION OF THE INVENTION

Definitions

Shower curtain vs shower curtain liner: As previously discussed, some shower curtains have liners, and some shower curtains lack liners. In this disclosure, although the terms "shower curtain" and "shower curtain liner" are sometimes used interchangeably, the invention is directed to the portion of a shower curtain configured to be disposed closest to the inside of the shower.

Magnetic card/suction cup: Although in this specification, the term "magnet, or "magnetic card" or "magnetic card/suction cup" is used as a term to describe magnets or suction cups that may be arrayed along the bottom of the shower curtain, it should be understood that the term "card" is not intended to be limiting. Indeed, any magnet or suction cup shape is contemplated.

Figure 1:
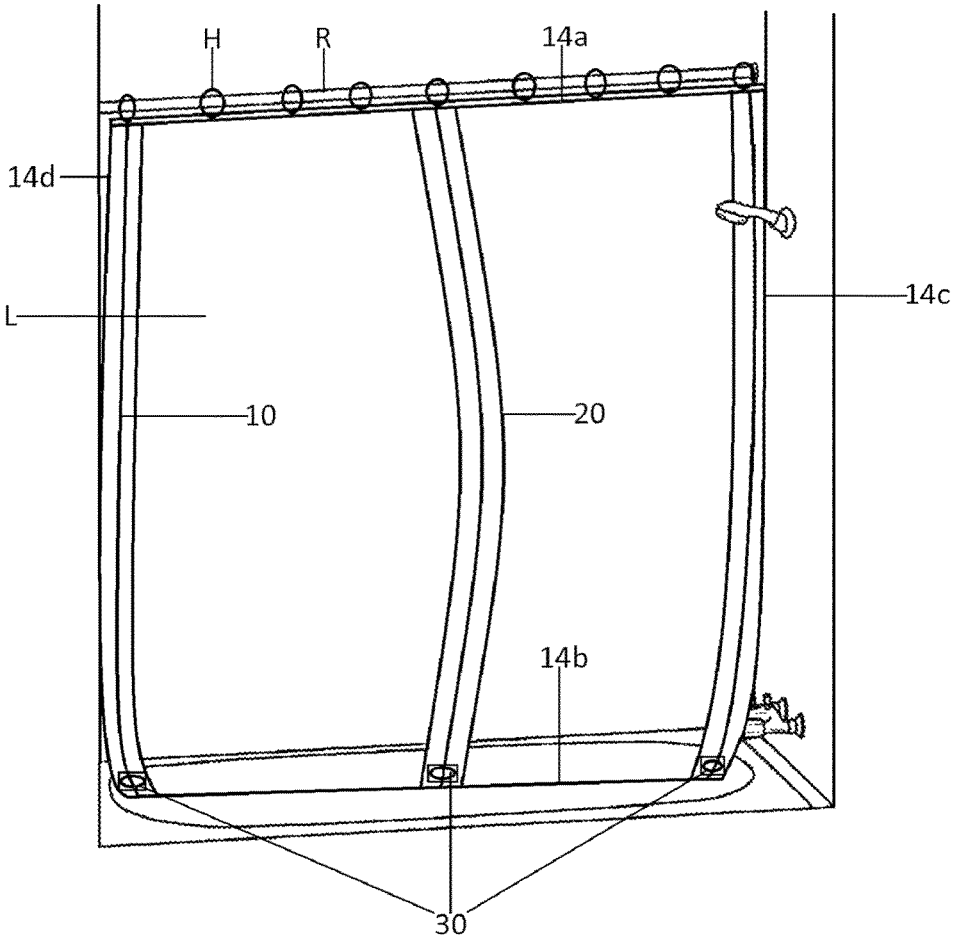
FIG. 1 shows an example of a curved outward shower curtain liner from an inside of the shower view while expanded (e.g., the shower curtain is closed). Here assume that the shower curtain/liner is relatively transparent.

FIG. 1 shows an example of a curved outward shower curtain liner L (a vertical model/version) from an inside of the shower view in an expanded state according to the present disclosure.

In some embodiments, the invention may be a shower curtain liner device. This device will generally comprise a foldable body (L) with a body top (14*a*), body bottom (14*b*), body left side (14*d*), and body right side (14*c*). This body will generally comprise a flexible, water-impermeable material, such as plastic or water repellant fabric. The body left sides (14*d*), and body right sides (14*c*) are configured to be capable of reversibly folding and unfolding from a first shorter folded width to a second longer unfolded width.

The body (L) is typically further configured (often with any of holes, eyelets, hooks, and the like) to receive at least one attachment mechanism (such as rings) configured to attach the body to a linear suspension mechanism (such as a rod R) so that the body left side and the body right side can reversibly fold and unfold while the body top is attached to the linear suspension mechanism (e.g., rod R). In some cases, body L can comprise two or more layers that are laminated together.

The body (L) will also typically comprise a plurality of rigid or semi-rigid supports (whips, rods 10) disposed between the top and the bottom. These supports have their support tops and support bottoms. As will be discussed (see FIG. 3), at least some of these supports are configured to be capable of assuming a curved state. In this curved state, the support is curved so that portions of the support in between the support top and the support bottom are displaced by at least six inches from where they would be if the support were in a straight line (linear). In other words, the curved supports will be configured to have a displacement of at least six inches. Because the supports are attached to the flexible body, these supports cause the body (e.g., shower curtain liner) to assume a displacement of at least six inches when these supports are in a curved state. Note, however, that as will be discussed, these supports need not always be in a curved state.

Put alternatively, on a first embodiment, the curved outward shower curtain liner L has a top edge 14*a*, a bottom edge 14*b*, a right edge 14*c*, and a left edge 14*d*. A plurality of hooks, fasteners, or rings H are attached or are already a part (hookless models) of the curved outward shower curtain liner L proximate the top edge 14*a*. This plurality of hooks, fasteners, or rings H suspend the curved outward shower curtain liner L from the shower rod R and permit slidable movement of the hook, rings, or fasteners H along the rod R to open and/or close the shower or tub.

As defined herein, a "shower room" contains a shower curtain liner L, a shower rod R, a bathtub/shower stall, and a plurality of hooks, fasteners, or rings H. A bathtub/shower stall includes an opening for user entry and/or user exit.

As shown in FIG. 1, the curved outward shower curtain liner L is in an expanded state as suspended from rod R. In the expanded state; liner L substantially covers the opening of the bathtub/shower stall. Rod R is mounted substantially horizontally across the opening of the bathtub/shower stall and can be close to the ceiling of the shower room.

The curved outward shower curtain liner L can be cordless, vertically and/or horizontally pleated, and/or cellular. However, note that other types of curved outward shower curtain liners L are also possible, such as a Venetian blind, a roman shade, or any other curtain typically used as a window covering.

Appearance and optical properties: In some embodiments, the curved outward shower curtain liner L can have light filtering, light polarizing, darkening, or blackout properties. It can be transparent, translucent, or opaque. The light filtering properties can also, for example, be used to depict images and/or text and/or shadows on a wall within the shower for view of a person showering. The curved outward shower curtain liner L may also have different designs depicted on one or both sides of a curved outward shower curtain liner L.

In general, the shower curtain liner body and the supports as well, as desired, can be configured to assume at least one optical appearance or pattern. These can be printed designs, or alternatively electronic images. For example, in some embodiments, flexible electronic display screens may be embedded into the shower curtain liner body.

Shape and fold structure: In some embodiments, the curved outward shower curtain liner L can have a folding structure similar to a horizontally or vertically pleated window blind, which can be opened and closed side to side or up and down (depending on model) by any of manual or electronic actuator (e.g., motor) action. The overall shape of the shower curtain liner L can be any shape, including a parallelogram, a polygon, an ellipse, a triangle, or an irregular shape.

In some embodiments, the shower curtain liner L can further comprise a single, a double, or a multiple layers of collapsible voids that provide insulation when the curtain liner L is in the extended state.

Mounting methods: The curved outward shower curtain liner L can be coupled to rod R, the frame, or the wall in any way. Rod R can be a straight rod, a wavy rod, an arcuate rod, a bent rod, a zigzag rod, a telescoping rod, a hinged foldable rod, and so forth. Rod R can have a smooth surface, a rough surface, a rugged surface, and so on.

In general, the least one attachment mechanism used to couple the shower curtain liner L (body) to the attachment mechanism is disposed along top of the body (body top). However, as will be discussed in FIG. 4, other configurations are possible.

As previously discussed, in some embodiments, the curved outward shower curtain liner L may be secured to rod R via hooks, fasteners or rings H coupled to the top 14*a* of a curved outward shower curtain liner L. Alternatively, liner L may be secured to rod R or top 14*a* via adhesives, magnets, mating mechanisms, suction cups and/or other similar securing/fastening/coupling methods. For example, support or mounting brackets/head-rails can be used along with screws for attachment, and the liner L can be mounted inside or outside the bracket. In some embodiments, a valance may be used to cover the mounting bracket or head-rail.

The mounting bracket can be attached to a wall or the ceiling. In some embodiments, at least two mounting brackets or bars can be used. This can allow for a part of a curved outward shower curtain liner L to move substantially horizontally.

When a frame is used, then the frame itself may be made from any material, which allows attachment to a curved outward shower curtain liner L. Liner L can then travel within the frame, such as via frame rails.

Movement mechanisms: The curved outward shower curtain liner L can be pulled via a rod or other device, such as a pull tag. Alternatively, it may be controlled via a motor (e.g., electric motor) and a remote-control device. In some embodiments, curtain liner L can be under automatic control and can be opened automatically when water from a showerhead is turned off. Otherwise, shower curtain liner L can stay in any position indefinitely.

Materials: The shower curtain liner L (body) will typically comprise waterproof material. It can comprise at least one of vinyl, plastic, polymer, carbon fiber, metal, wood, rubber, and so forth. In some embodiments, it can also comprise anti-bacterial and/or anti-mildew and/or anti-mold coatings or materials.

Bottom of the shower curtain liner: In some embodiments, shower curtain liner L can have weights on the bottom 14*b* to keep a curved outward shower curtain liner L in place, as discussed herein. Alternatively, the bottom of the shower curtain liner may comprise adhesives, magnets, mating mechanisms, suction cups and/or any other securing/fastening/coupling technologies coupled to the bottom 14*b* such that these securing/fastening/coupling technologies can couple the bottom 14*b* to bathtub/shower stall or a floor in the shower room. In some embodiments, such suction cups can also be added to the sides of the shower curtain as well.

Put alternatively, in some embodiments, the body bottom can comprise a plurality of reversible attachment devices configured to reversibly attach the body bottom to at least one type of shower tub. These attachment devices can comprise any of weights, magnets or suction cups.

The curved outward shower curtain liner L can be hung over one side of tub/shower stall, enclosing tub/shower stall, surrounding tub/shower stall, or if tub/shower stall has some open geometric shape, like U-shaped, then a curved outward shower curtain liner L can cover the open space.

Shower Curtain Liner Supports (Whips/Pole) Components:

To help produce the desired curved outward shape, in some embodiments, shower curtain liner L may comprise variously curved outward supports, such as whips/poles 10. These supports (whips/poles) can be semi-hard, completely hard, soft, or flexible. These curved outward supports 10 can be attached to the shower curtain liner L via various methods, including but not limited to being integrated/part of the liner, or sewn, clipped, slipped into the liner, or seamed into the liner. The whips/poles 10 may be configured to stay in any position indefinitely or may be configured to transition between a curved and linear configuration.

In other words, these supports may be attached to the body of the liner by any of adhesives stitches, or seams. Alternatively, the supports may be embedded in the body.

In some embodiments, these supports may be configured to transition between a curved state and a linear state. This will in turn, cause the shower curtain liner body to assume a lesser displacement when these supports are in a linear state. This transition can be triggered by any of electromechanical, mechanical, or chemical force.

The curved outward supports (whips/poles 10) can made from any material(s) or combinations of materials, including but not limited to vinyl, plastic, polymer, carbon fiber, metal, wire, wood, rubber, and so forth. They can also comprise anti-bacterial and/or anti-mildew and/or anti-mold coatings and/or materials.

Further magnetic card/suction cup discussion: Note that in some embodiments, magnetic cards/suction cups 30 may be only magnetic cards. In other embodiments, they may be only suction cups. In still other embodiments, combination magnetic cards and suction cups are contemplated.

In some embodiments, affixed to the bottoms of the curved outward supports (whips/poles) 10 and/or also sewn or seamed into the curved outward shower curtain liner are the previously discussed magnetic cards or suction cups 30. These help secure the shower curtain liner to the inside of the shower tub (especially in the corners).

These magnetic cards or suction cups 30 (depending on their styles) can be of various shapes, including but not limited to circular, oval, triangle, rectangular, square, etc. The suction cup embodiments may be made from any material, and affixed via any method, usually with the suction facing towards the outside of the shower (so that it can stick to the shower enclosure.

In some embodiments, the magnetic cards/suction cups 30 can comprise anti-bacterial and/or anti-mildew and/or anti-mold materials and/or coatings.

Interaction Between Magnetic Cards/Suction Cups and the Whips/Poles:

As previously discussed, the magnetic cards/suction cups 30 can be attached to the shower curtain liner L and the curved outward supports (whips/poles) 10 via various methods, including but not limited to being integrated/part of, sewn, clipped, slipped into, or seamed into shower curtain liner L.

Alternatively, the magnetic cards/suction cups 30 may be attached to the curved outward supports (whips/poles) 10 and can be attached entirely, partially attached, or indirectly attached to the shower curtain liner L as desired.

In some embodiments, if the magnetic cards/suction cups 30 are attached to the curved outward supports (whips/poles) 10 and are also completely attached to the curved outward shower curtain liner L, they will not extend past 14*b*. However, if the magnetic cards/suction cups 30 are connected to the curved outward supports (whips/poles) 10, and these are semi/partially attached to the curved outward shower curtain liner L, they may partially extend/protrude past 14*b*. In other embodiments, if the magnetic cards/suction cups 30 are attached to the curved outward supports (whips/poles) 10 and are not directly attached to the shower curtain liner L, they may completely extend past 14*b*.

Although as few as one (or even none at all) magnets or suction cups may be used, typically, a plurality of magnets/suction cups 30 and curved outward supports (whips/poles) 10 will be attached to the shower curtain liner L. The one or more curved outward supports (whip/poles) 10 may have varying widths, and in some embodiments, may form the entire curved outward shower curtain liner L.

As previously discussed, if made from materials that can expand or contract, the shower curtain liner L can be configured to reversibly transition back and forth from a normal flat shower curtain liner to a curved outward shower curtain liner L depending on the environment (e.g., presence of moisture) or control signals, such as electrical control signals. Other control methods such as response to temperature, chemical stimuli, or response to mechanical stimuli (e.g., spring action, such as a click from a bending metal disk) may also be used.

For example, in some embodiments, the supports can be configured to transition between a curved state and a linear state, thus causing the body (shower curtain liner) to assume a lesser displacement when the supports are in a linear state. This transition can be triggered by any of electromechanical, mechanical, or chemical force.

Figure 2:
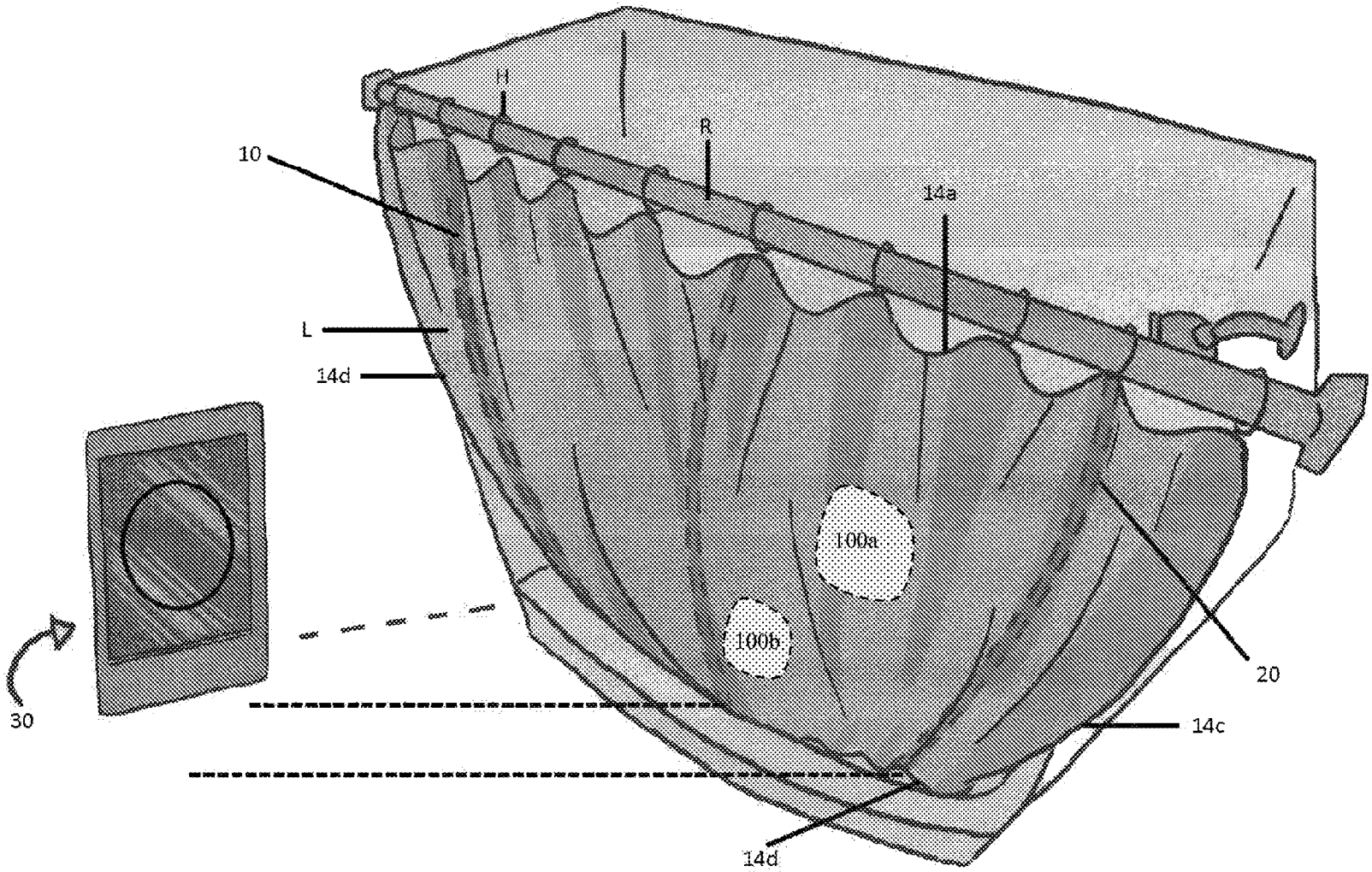
FIG. 2 shows an example of a curved outward shower curtain liner from the shower outside while expanded (closed).

FIG. 2 shows an example of a curved outward shower curtain liner from the outside of the shower view, in which the shower curtain liner is in an expanded state (e.g., open).

Curtain liner L can be open or closed as desired. To open shower curtain liner L, it can be pulled sideways (either manually or automatically) from either side 14*c* or 14*d* toward the opposite side via pulling on 14*c* or 14*d* depending on which side is desired to be opened from. Similarly curtain liner L can be closed by applying a force in a direction towards either 14*c* or 14*d*, which effectively causes the curved outward shower curtain liner L to collapse, bunch and/or fold against itself. When the force is removed, shower curtain liner L can remain in the semi-expanded/retracted/open state indefinitely. 100*a* and 100*b* show examples of pockets, which will be discussed in more detail shortly.

Automatic opening or closing can be done by pressing a button, or operating a switch, or a touchscreen display, or pulling a lever, located on a curved outward shower curtain liner L and/or with simultaneously manually raising or lowering a curved outward shower curtain liner L. Alternatively, the shower curtain liner L can be automatically opened or closed under computer processor control, such as through a voice command which is input into voice recognition input unit input. In this embodiment, if a user says "open," then the shower curtain liner L opens, and if the user says "close," then the shower curtain liner L closes.

Figure 3:
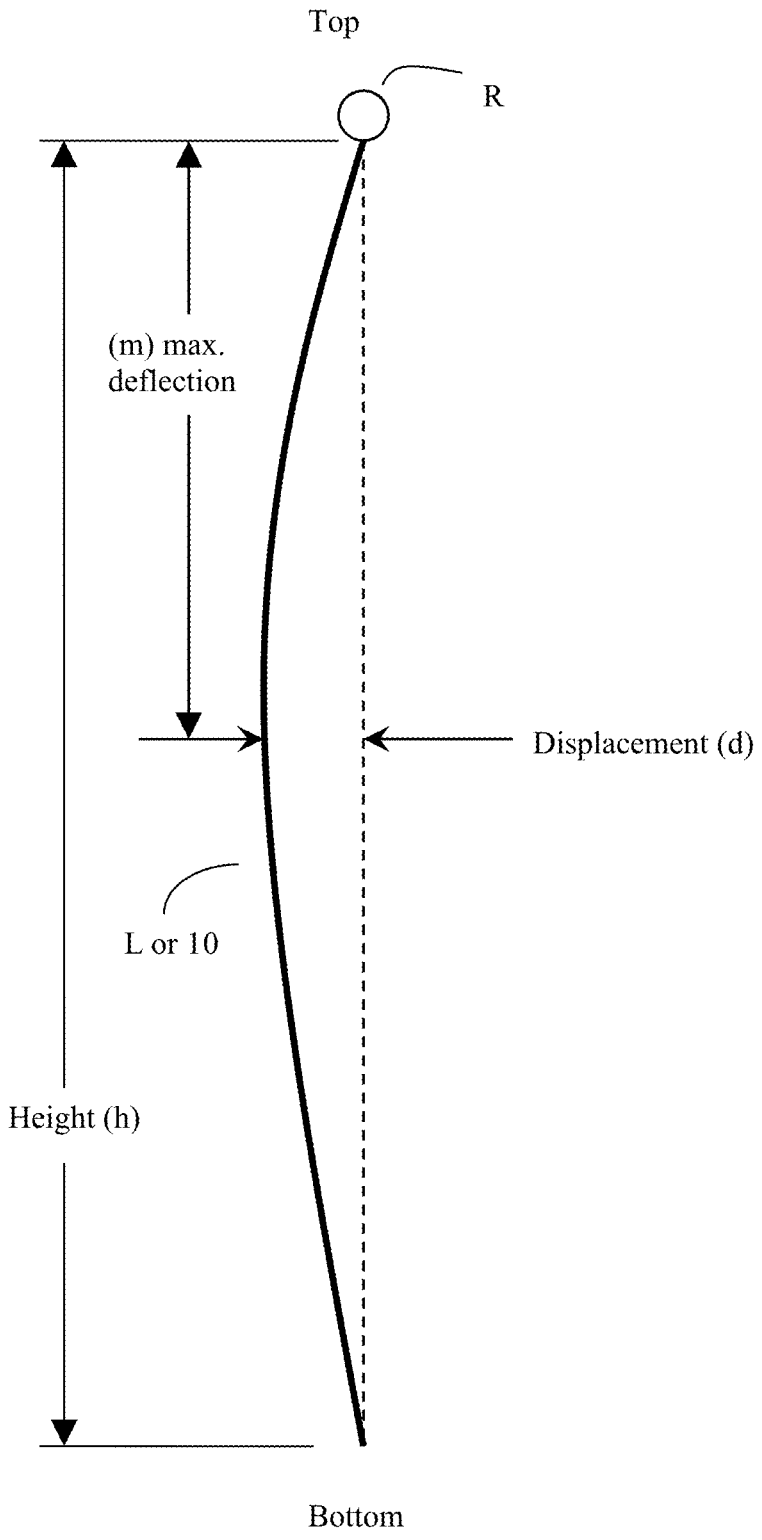
FIG. 3 shows a cross-section of the support (whip/pole) showing the extent and region of outward curvature.

FIG. 3 shows a cross-section of the shower curtain or shower curtain whip/pole showing the extent and region of outward curvature.

Definition of "curved outward": A standard shower curtain has a height (h) of about 72 inches, although extra-high shower curtains capable of extending up to the ceiling, with heights of 84 inches or greater are also contemplated.

In contrast to prior art shower curtains, which generally are configured to hang flat from their mounting structures, the "curved outward" shower curtains disclosed herein will typically be configured to curve outward with a displacement (d) of at least six inches between the shower curtain's top and the bottom of the shower curtain. In some embodiments, the shower curtain may be configured with a displacement (d) extending even further, such as 9 inches, 12 inches, 15 inches, 18 inches, 24 inches, or more. Although typically, the region of maximum deflection (m) will be parallel to the top and bottom of the shower curtain (at least for rectangular shower curtains), this is not intended to be limiting. In some embodiments, the region of maximum deflection may vary across the width of the shower curtain. Thus, specific configurations, where the region of maximum deflection proceeds diagonally across the width of the shower curtain, are contemplated, and other configurations are also possible.

In more common embodiments, the curvature may have a displacement of between six inches and twelve inches.

Although often, the region of maximum outward deflection (m) may be midway between the top and bottom of the shower curtain, this is not intended to be limiting. In some embodiments, the region of maximum deflection (m) may be configured to be any of 90%, 80%, 70%, 60%, 50%, 40%, 30%, 20% or even 10% of the distance between the top and bottom of the shower curtain (h). For example, a curved outward shower curtain intended for tall adults may have the region of maximum deflection configured towards the top of the shower curtain. A curved outward shower curtain intended for shorter individuals may have the region of maximum deflection configured towards the bottom of the shower curtain.

Figure 4:
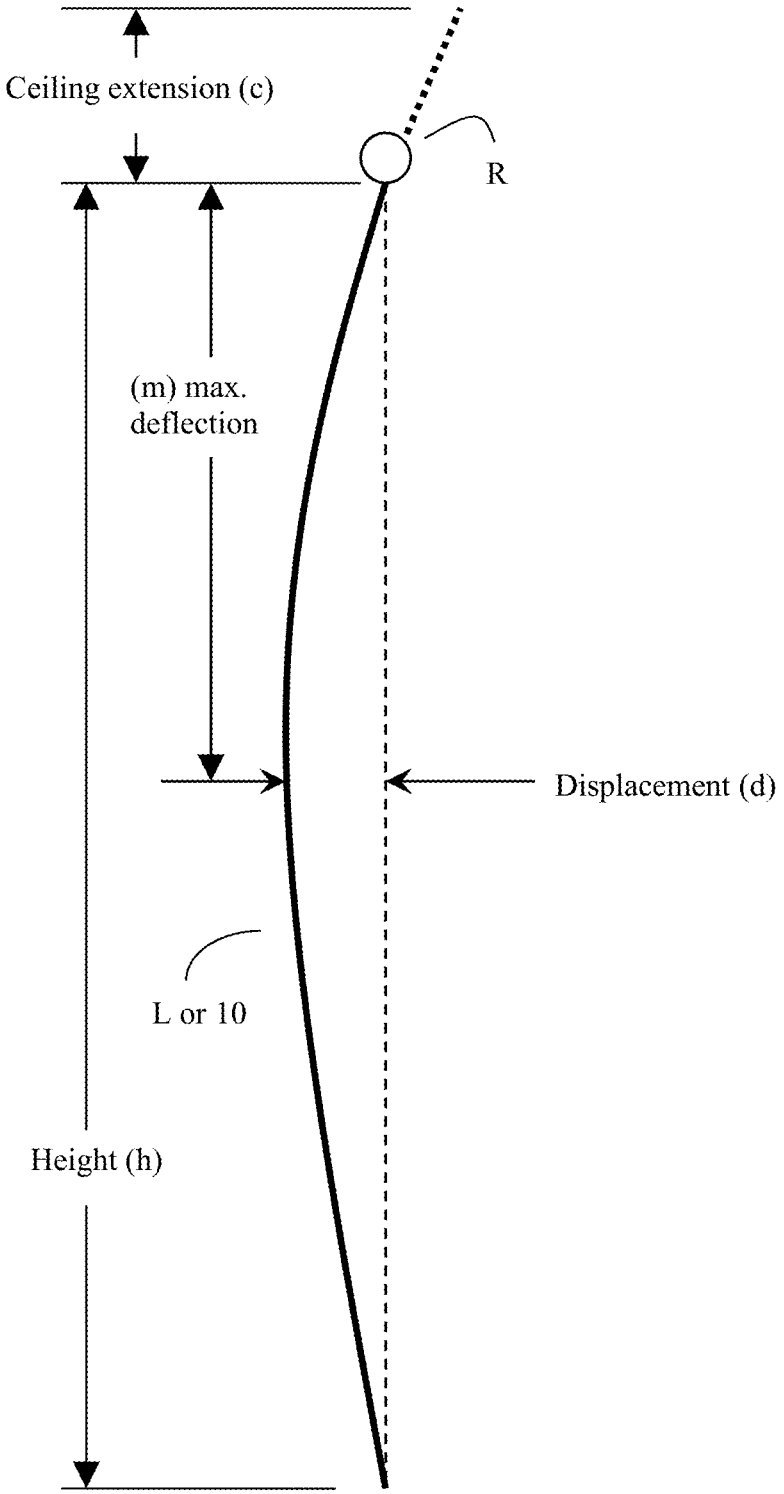
FIG. 4 shows an embodiment where the supports (whips/poles) can be used to support and extend the shower curtain above the level of the supporting curtain rod.

FIG. 4 shows an embodiment where the supports (whips/poles) 10 can be used to support and extend the shower curtain above the level of the supporting curtain rod (R), possibly up to the ceiling as desired. Here this additional length is called a "ceiling extension" c.

In this embodiment, at least one attachment mechanism may be disposed parallel to the body top, but displaced from the body top. The supports may be configured to extend above this at least one attachment mechanism. These supports can thus support at least a portion of the shower curtain liner body above the level of the at least one attachment mechanism.

Figure 5:
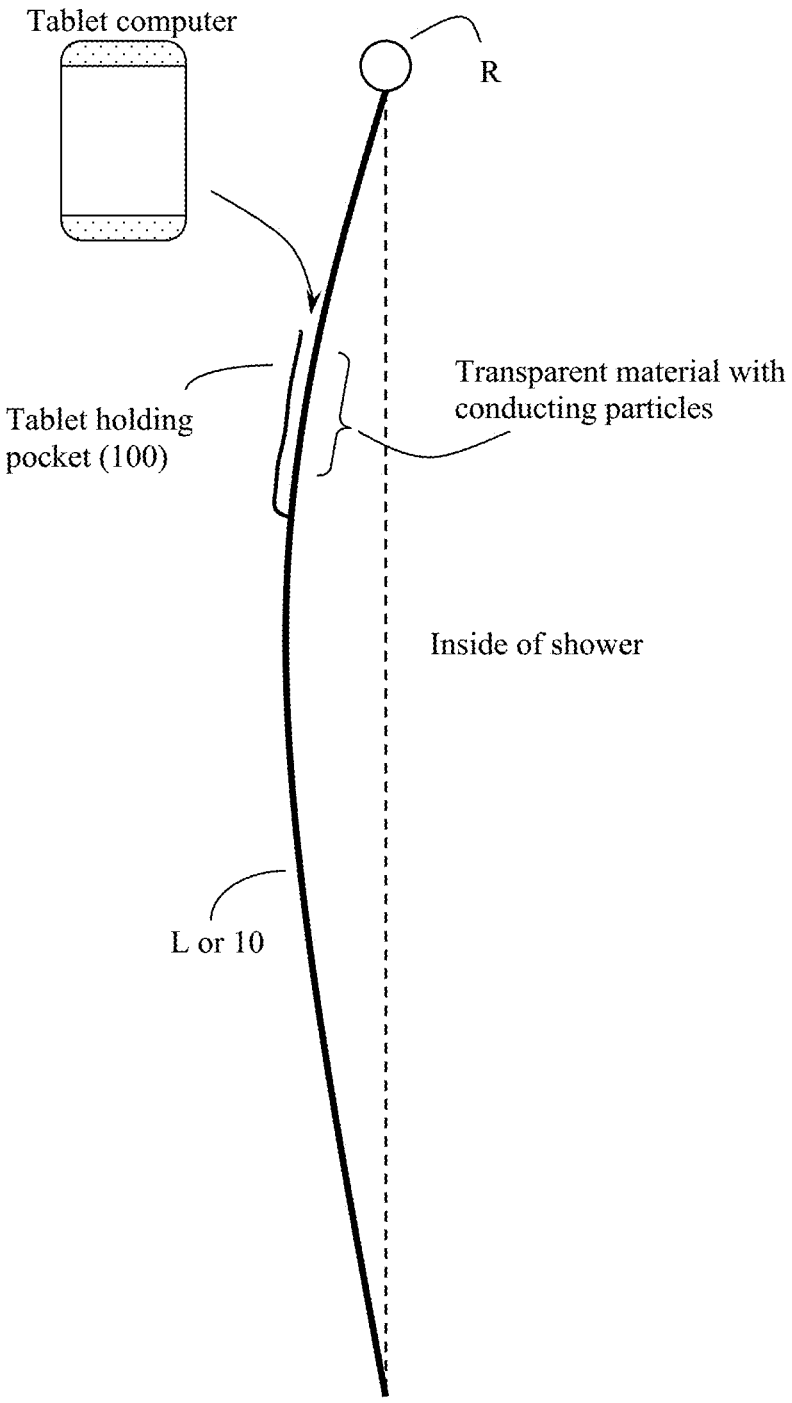
FIG. 5 shows how in some embodiments, a "tablet pocket" may be mounted on the side of the curtain facing away from the shower.

FIG. 5 shows how in some embodiments, a "tablet pocket" 100 may be mounted on the side of the curtain facing away from the shower, with the inner side of the curtain made transparent, with suitable materials such that a user can operate a touch screen computerized device such as a tablet computer or a smartphone without getting the computerized device wet.

Note that the shower curtain liner body has a shower facing side and an opposite side. In the "pocket embodiment," the body further comprises at least one tablet computer fixture. This at least one tablet computer fixture will typically comprise at least one pocket disposed on the opposite side of the body. The shower facing side of the pocket will comprise a transparent material (so that the touch screen can be seen) and further comprise conducting particles coated on or embedded in the transparent. These conducting materials are often needed to allow touch screens, such as standard capacitive touch screens, to register touches. This embodiment enables a tablet computer touchscreen to be both seen and operated by a user from inside the shower.

In this embodiment, at least the portion of the shower curtain or shower curtain liner in the side of the pocket that faces the inside of the shower should preferably comprise a transparent conducting plastic optimized for capacitive touchscreens. This transparent material may comprise, or be coated with, various conducting threads, such as short carbon fiber threads, or short metallic threads with a density low enough to maintain transparency, but with enough conductivity so that the transparent material will register on the touchscreen when the user touches the transparent material.

In some embodiments, the pockets may vary in sizes, shapes, and numbers. These pockets may additionally comprise various holes to allow tablet computers to be charged by low voltage cable connections from outside the shower. Other pockets may have flaps and sealing mechanisms, such as zippers, buttons, hook and loop fasteners, and the like. In some embodiments, there may be multiple rows of pockets arranged horizontally across the curtain liner. These pockets may alternate in sizes and heights, allowing for bathers of different heights to use them. FIG. 2 shows examples of two pockets 100*a*, and 100*b*, with different sizes, and mounted at different heights.

The invention claimed is:

1. A shower curtain liner device, said device comprising:

a foldable body with a body top, body bottom, body left side, and body right side, said body comprising a flexible, water impermeable, material configured with body left sides and body right sides capable of reversibly folding and unfolding from a first shorter folded width to a second longer unfolded width;

said body further configured to receive at least one attachment mechanism configured to attach said body to a linear suspension mechanism so that said body left side and said body right side can reversibly fold and unfold while said body top is attached to said linear suspension mechanism;

said body further comprising a plurality of rigid or semi-rigid supports disposed between said top and said bottom, said supports having support tops and support bottoms;

at least some of said supports configured to be capable of assuming a curved state wherein portions of the support in between said support top and said support bottom assume a curvature with a displacement of at least six inches, thus causing said body to assume a displacement of at least six inches when said supports are in said curved state;

wherein said supports are configured to transition between said curved state and a linear state, thus causing said body to assume a lesser displacement when said supports are in a linear state.

2. The device of claim 1, wherein said body bottom comprises a plurality of reversible attachment devices configured to reversibly attach said body bottom to at least one type of shower tub, said attachment devices comprising any of weights, magnets or suction cups.

3. The device of claim 1, wherein said supports are attached to said body by any of adhesives or stitches, or wherein said supports are embedded in said body.

4. The device of claim 1, wherein said transition is triggered by any of electromechanical, mechanical, or chemical force.

5. The device of claim 1, wherein said body has a shower facing side and an opposite side, wherein said body further comprises at least one tablet computer fixture, said at least one tablet computer fixture comprises at least one pocket with a shower facing side attached to said opposite side, and wherein said shower facing side of said pocket comprises a transparent material comprising conducting particles configured to enable a tablet computer touchscreen to be both seen and operated from inside said shower.

6. The device of claim 1, wherein said at least one attachment mechanism is disposed along said body top.

7. The device of claim 1 wherein said at least one attachment mechanism is disposed parallel to said body top, but displaced from said body top, and wherein said supports are configured to extend above said linear suspension mechanism, thus supporting at least a portion of said body above a level of said at least one attachment mechanism.

8. The device of claim 1, wherein said curvature has a displacement of between six inches and twelve inches.

9. The device of claim 1, wherein said body is configured with at least one flexible electronic display screen configured to assume at least one optical appearance.

10. A method for increasing a volume of a shower, said method comprising:

Using a shower curtain liner device to create an outer boundary to a shower;

Said shower curtain liner device, comprising:

a foldable body with a body top, body bottom, body left side, and body right side, said body comprising a flexible, water impermeable, material configured with body left sides and body right sides capable of reversibly folding and unfolding from a first shorter folded width to a second longer unfolded width;

said body further configured to receive at least one attachment mechanism configured to attach said body to a linear suspension mechanism so that said body left side and said body right side can reversibly fold and unfold while said body top is attached to said linear suspension mechanism;

said body further comprising a plurality of rigid or semi-rigid supports disposed between said top and said bottom, said supports having support tops and support bottoms;

at least some of said supports configured to be capable of assuming a curved state wherein portions of the support in between said support top and said support bottom assume a curvature with a displacement of at least six inches, thus causing said body to assume a displacement of at least six inches when said supports are in said curved state;

configuring said shower curtain in a second longer unfolded state;

if said supports are not in said curved state, causing said supports to assume said curved state so that said curvature is directed outward from an interior of said shower, thus increasing said volume of said shower;

wherein said supports are configured to transition between said curved state and a linear state, thus causing said body to assume a lesser displacement when said supports are in a linear state.

11. The method of claim 10, wherein said body bottom comprises a plurality of reversible attachment devices configured to reversibly attach said body bottom to at least one type of shower tub, said attachment devices comprising any of weights, magnets or suction cups, further attaching said body bottom to at least one type of shower tub using any of said weights, magnets, or suction cups.

12. The method of claim 10, wherein said supports are attached to said body by any of adhesives or stitches, or wherein said supports are embedded in said body.

13. The method of claim 10, wherein said transition is triggered by any of electromechanical, mechanical, or chemical force, further using any of said electromechanical, mechanical, or chemical force to trigger said transition.

14. The method of claim 10, wherein said body has a shower facing side and an opposite side, wherein said body further comprises at least one tablet computer fixture, said at least one tablet computer fixture comprises at least one pocket with a shower facing side attached to said opposite side, and wherein said shower facing side of said pocket comprises a transparent material comprising conducting particles configured to enable a tablet computer touchscreen to be both seen and operated from inside said shower;

placing any of a tablet computer or a smartphone inside said pocket, and operating said touchscreen through said transparent material.

15. The method of claim 10, wherein said at least one attachment mechanism is disposed along said body top.

16. The method of claim 10, wherein said at least one attachment mechanism is disposed parallel to said body top, but displaced from said body top, and wherein said supports are configured to extend above said linear suspension mechanism, thus supporting at least a portion of said body above a level of said at least one attachment mechanism.

17. The method of claim 10, wherein said curvature has a displacement of between six inches and twelve inches.

18. The method of claim 10, wherein said body is configured with at least one flexible electronic display screen configured to assume at least one optical appearance.

* * * * *